United States Patent [19]

Posey et al.

[11] Patent Number: 4,803,827

[45] Date of Patent: Feb. 14, 1989

[54] MEANS FOR SEGREGATING STERILE AND NONSTERILE ENVIRONMENTS IN A PACKAGING MACHINE

[75] Inventors: John L. Posey, McHenry; Ronald W. Swank, Crystal Lake; Frederic L. Grude, Ringwood, all of Ill.

[73] Assignee: Baxter International Inc., Deerfield, Ill.

[21] Appl. No.: 121,488

[22] Filed: Nov. 17, 1987

[51] Int. Cl.[4] ..... B65R 9/06; B65B 55/04

[52] U.S. Cl. ..... 53/167; 53/551; 53/373

[58] Field of Search ..... 53/167, 551, 373; 74/18.2

[56] References Cited

U.S. PATENT DOCUMENTS

| | | | |
|---|---|---|---|
| 2,524,560 | 10/1950 | Cote | 53/167 X |
| 3,964,238 | 6/1976 | Bippus | 53/167 |
| 4,154,434 | 5/1979 | Wallis | 74/18.2 X |
| 4,296,068 | 10/1981 | Hosttino | 53/167 X |
| 4,409,775 | 10/1983 | Brody | 53/167 |

*Primary Examiner*—John Sipos

*Attorney, Agent, or Firm*—Paul C. Flattery; Robert M. Barrett; Mary R. Jankousky

[57] ABSTRACT

A packaging machine for creating from a web of flexible film a bag for housing a product comprising an apparatus for feeding a web of film through the packaging machine, a sealing station for heating the web of film to create seals in the web of film, the sealing station including a pair of jaws located diametric each other, at least one of the jaws having coupled thereto a member for heating the web of film, and the second jaw having coupled thereto a back-up bar, the jaws being coupled to a member for urging the jaws towards each other. The packaging machine includes boots for segregating a sterile area of the packaging machine through which the web of film is fed, from nonsterile areas, the boots including a plurality of flexible, pleated rubber members that segregate nonsterile internal areas of the sealing station from the sterile area.

23 Claims, 4 Drawing Sheets

MEANS FOR SEGREGATING STERILE AND NONSTERILE ENVIRONMENTS IN A PACKAGING MACHINE

The present invention relates generally to aseptic systems. More specifically, the present invention relates to a system for securing the aseptic areas of an aseptic form, fill, seal packaging machine from the nonaseptic areas of the aseptic form, fill, seal packaging machine.

Typically, form, fill, seal packaging machines are utilized to package a product in a flexible container. To this end, form, fill, seal packaging machines are used to seal pharmaceuticals, dairy products, wine, food stuffs, cosmetics, and other products in flexible containers. The form, fill, seal packaging machine provides an apparatus for packaging these products in an expedient manner.

In one type of form, fill, seal packaging machine, a web of heat sealable film is passed over a former or mandrel that forms the film into a tubular shape. To effect the tubular shape, the film is folded longitudinally and heat sealed along abutting longitudinal edges to create the fin seal. The tubular-shaped film is then passed around a tubular fill system that deposits the product to be packaged into the tubular-shaped film. To create individual packages (hereinafter "bags"), the web of film must be sealed across its width by side seals. The side seals are typically created by a sealer that creates the second seal for one bag while making the first seal for the next bag. After the side seals are created, the web of film can then be severed between the seals to create individual bags.

Typically, the bags are sealed at a heat sealing station. The heat sealing station functions to seal the film together by heating opposite sides of the tubular-shaped web of film to a sufficiently high temperature so that the sides melt together sealing the film. The folded web of film can be heat sealed utilizing two different systems. One system is an impulse heat sealing system wherein a wire or other element is intermittently fired to heat or weld the webs of film together. The second system is a hot-bar or static system wherein a sealing member is maintained in a heated state and is urged against the web of film to seal the film together.

Form, fill, seal packaging machines also typically have other stations at which the web of film is heated, such as, for example, a fitment attachment station and a fin sealing station for creating the fin seal. In some packaging arts it is desirable to attach a fitment to a web of film to provide a port for accessing the contents of the package. This can be done by sealing the web of film to the fitment.

It may be desirable to create the flexible bags containing the product aseptically in a sterile environment. For example, in the food products and pharmaceutical industry, because of regulatory requirements, typically the flexible bags must be created in a sterile environment or terminally sterilized after the packaging process. Because of the thermal sensitivity of the products to be packaged, terminal sterilization is not always practical. Moreover, terminal sterilization of the flexible bags increases the cost of producing the packaged product. Accordingly, if possible, it can be advantageous to create the flexible bags aseptically in a sterile environment.

One of the difficulties in producing a flexible bag containing an aseptic product in a form, fill, seal packaging machine is providing an aseptic environment within the packaging machine. This is especially true at the sealing stations and fitment attachment stations. Due to the moving parts, electrical connections, cooling members, and heating elements, utilized at these stations, it is difficult to segregate the nonsterile and sterile areas so that an aseptic environment is provided and maintained.

One must not only be concerned with providing and maintaining an aseptic environment, but also with protecting some of the areas of the packaging machine from the sterilant used to sterilize the machine. The sterilization process can be detrimental to the moving parts of the form, fill, seal packaging machine. It is known, for example, to sterilize a portion of a form, fill, seal packaging machine, by fogging the interior of the machine with hydrogen peroxide. If, however, the entire internal environment of the form, fill, seal packaging machine is so fogged, the hydrogen peroxide will remove necessary lubricants from the moving parts of the packaging machine. But, on the other hand, if there are lubricants in the sterile area they can harbor microorganisms and subsequently protect them during any sterilization process.

Further difficulty in providing an aseptic form, fill, seal packaging machine is that certain moving parts and apparatus are notoriously difficult, if not impossible, to sterilize. For example, it is almost impossible to sterilize compressed air driven devices.

Accordingly, there is a need for means for segregating a sterile portion of a machine from a nonsterile portion of a machine in a form, fill, seal packaging machine.

The present invention provides a packaging machine comprising a sterile area, through which a web of flexible film is fed, and nonsterile areas. A plurality of pleated flexible rubber members are utilized to segregate the sterile area from the nonsterile areas.

In an embodiment, the packaging machine includes a static sealing station for creating side seals in the web of film.

In another embodiment, the packaging machine includes an impulse sealing station for creating side seals in the web of film.

In an embodiment of the invention, the packaging machine includes a sealing station for heating the web of film to create seals in the web of film. The sealing station includes a pair of jaws located diametric to each other, one of the jaws having coupled thereto means for heating the web of film and the second jaw having coupled thereto a backup bar. The jaws are coupled to means for urging the jaws towards each other. The packaging machine further includes a means for segregating the sterile area of the packaging machine, through which the web of film is fed, from the nonsterile areas. The means for segregating including a plurality of flexible pleated boots. The boots function to segregate the nonsterile internal areas of the means for sealing and backup bar from the sterile area of the packaging machine.

In an embodiment, the jaws are secured to plates that are journalled on rods that allow the jaws to move axially towards each other. Flexible pleated boots segregate internal areas of the rods and means for journalling the plates to the rods from the sterile area.

In an embodiment, two boots are utilized to segregate the internal nonsterile areas proximate the plates from the sterile area. The boots are so constructed and arranged that they prevent the nonsterile areas from becoming pressurized.

Accordingly, it is an advantage of the present invention to provide a means for segregating sterile and nonsterile environments to provide an aseptic form, fill, seal packaging machine.

A further advantage of the present invention is to provide means for providing a sterile barrier in an aseptic form, fill, seal packaging machine to provide a sterile environment.

Furthermore, an advantage of the present invention is to provide a means for securing or segregating an aseptic form, fill, seal packaging machine that utilizes a static hot-bar system.

Additionally, an advantage of the present invention is that it provides a means for sealing a form, fill, seal packaging machine that utilizes an impulse sealing system.

Still an advantage of the present invention is that it provides a sealing system that allows a standard compressed air device to be used in an aseptic form, fill, seal packaging machine.

An advantage of the present invention is also that it provides a means for separating the film pulling, film sealing, and film cutting functions.

Moreover, an advantage of the present invention is that it allows lubrication to be used on the moving parts of the packaging machine and isolates the lubrication from the sterile zones.

Additionally, an advantage of the present invention is that it provides means for venting the nonsterile areas to prevent pressurization of the nonsterile areas.

Still, another advantage of the present invention is that it allows cooling of the sealing components without contamination of the sterile environments.

Furthermore, an advantage of the present invention is that it provides access to electrical connectors in an aseptic manner.

Additional features and advantages are described in, and will be apparent from, the detailed description of the presently preferred embodiments and from the drawings.

Figure 1:
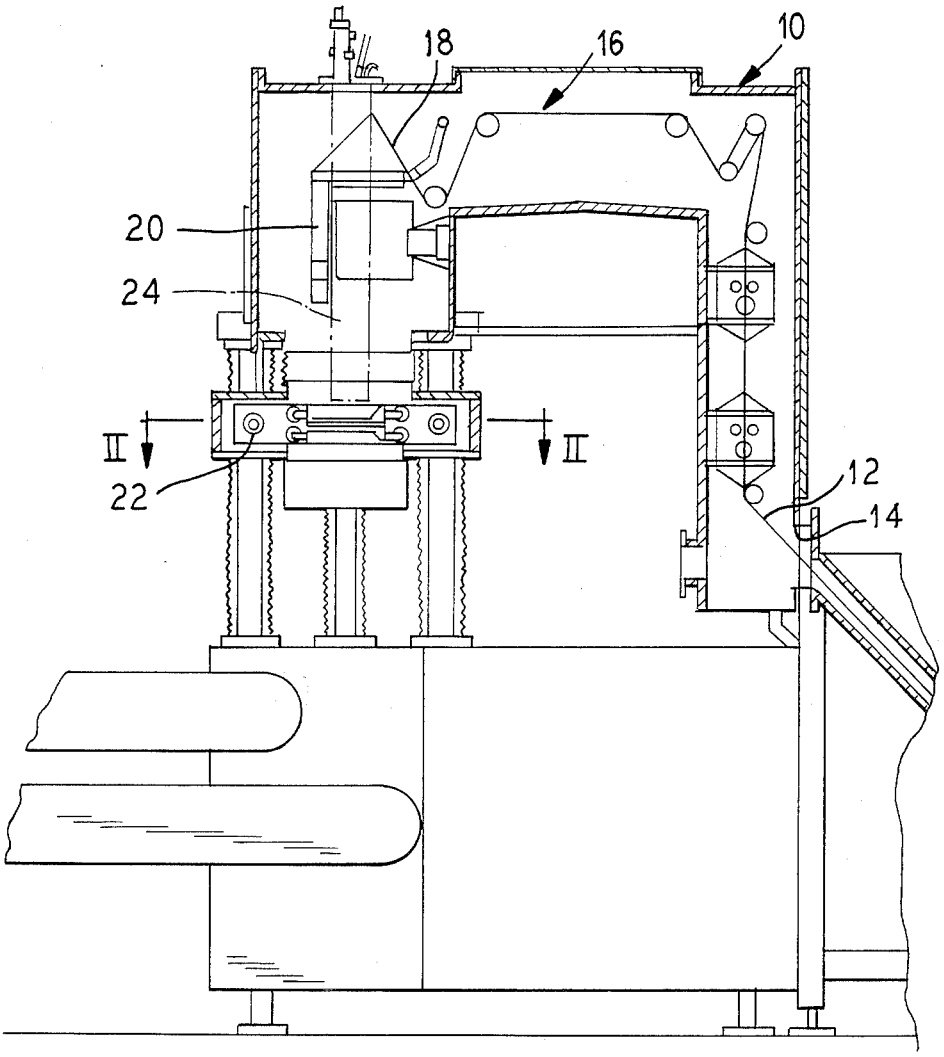
FIG. 1 illustrates a cross section perspective view of a form, fill, seal packaging machine utilizing an embodiment of the means for segregating of the present invention.

Referring now to FIG. 1, a form, fill, seal packaging machine utilizing the present invention is illustrated. As used herein, the term "form, fill, seal packaging machine" refers to a machine for creating, from a flexible web of film, a flexible bag for housing a product. In a typical form, fill, seal packaging machine, a web of heat sealable film is passed over a former that forms the film into a tubular shape. The film is folded longitudinally and heat sealed along abutting longitudinal edges to create the fin seal. A first side seal is created in the film, product is introduced into the tubular-shaped film, and a second side seal is then created. The film is then severed to create a flexible package. Of course, the segregating means of the present invention can be utilized in other packaging machines or in other apparatus where it is necessary to segregate one environment from another.

The form, fill, seal packaging machine 10 illustrated in the present invention is an aseptic form, fill, seal packaging machine. To this end, the form, fill, seal packaging machine 10 provides a sterile internal environment 16 in which the web of film 12 is formed, filled, and sealed to create a flexible package containing a product. As used herein the term "aseptic" or "aseptically" means to assemble sterile components in a sterile manner not requiring post production sterilization techniques.

Preferably, the web of film 12 is treated before it enters the form, fill, seal packaging machine 10 by being passed through a bath or other means (not illustrated) for treating the film. The web of film 12 then enters the packaging machine 10 through an opening 14 in the machine. The web of film 12 then travels through the packaging machine 10 to a former 18 where the film is formed into a tubular shape. A fin seal is created in the web of film 12 at the fin seal station 20. Side seals are created in the web of film 12 at the side seal station 22. A fill tube structure 24 is provided for dispensing, and thereby filling the tubular-shaped web of film 12 with a product.

The segregating means of the present invention provides a means for creating an aseptic form, fill, seal packaging machine 10. To this end, the segregating means provides a means for segregating the nonsterile environments of the packaging machine 10 from the sterile environments of the packaging machine 10. This ensures the sterility of the internal environment 16, while maintaining the lubrication and other coatings needed in the nonsterile environment for the mechanisms of each of the apparatus, e.g., means for creating the side seals.

Figure 2:
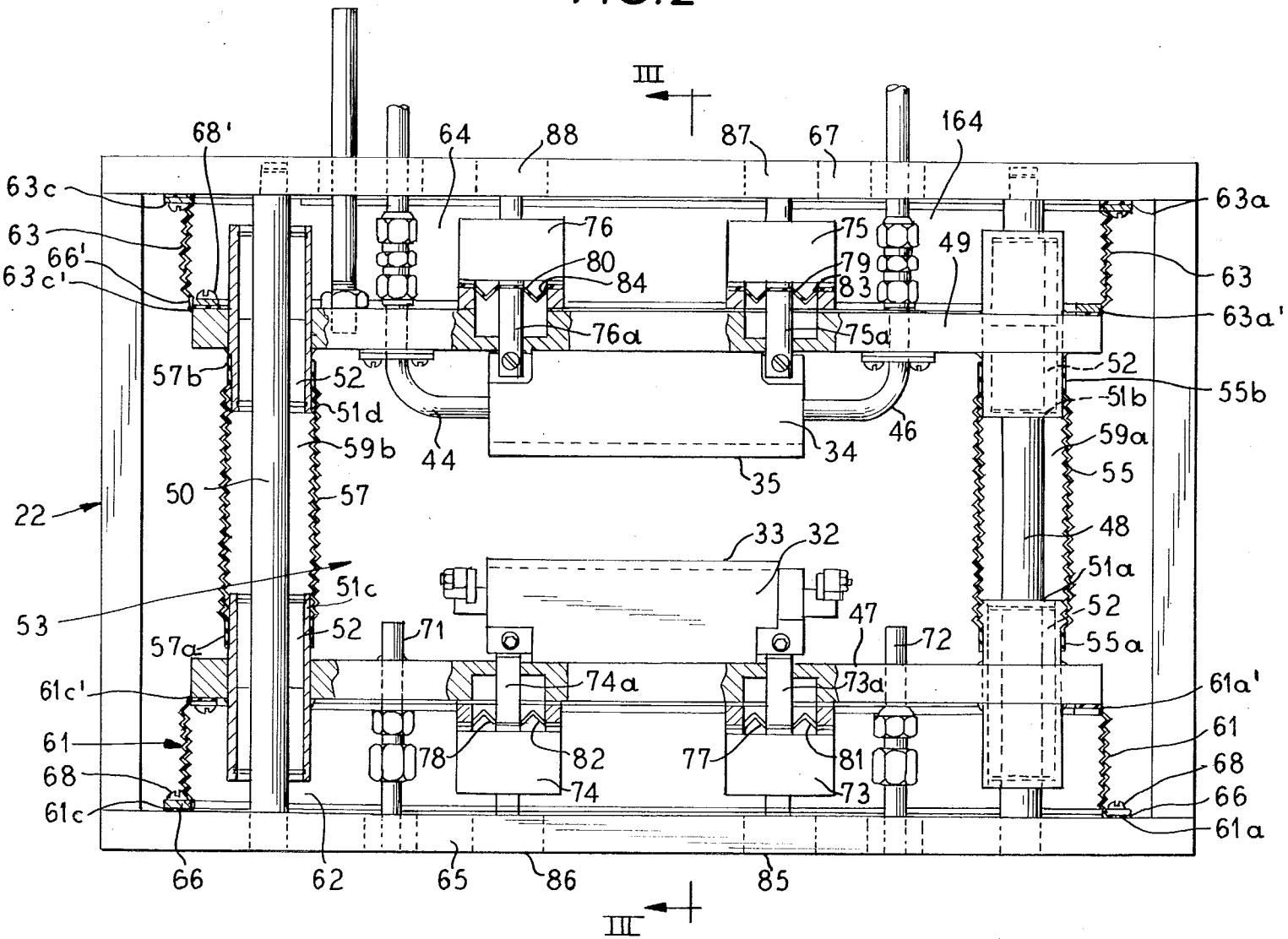
FIG. 2 illustrates a cross-sectional view of a heat sealing station of the form, fill, seal packaging machine utilizing the means for segregating of FIG. 1 taken along lines II—II.
Figure 3:
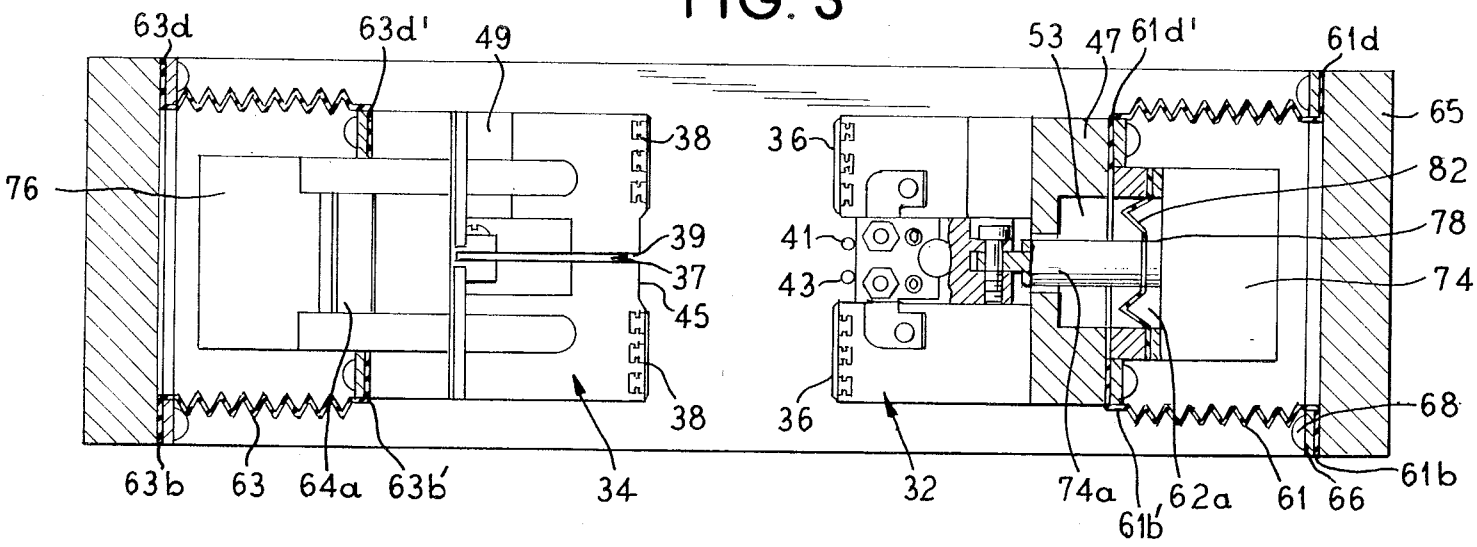
FIG. 3 illustrates a cross-sectional view of the means for segregating taken along lines III—III of FIG. 2.

Referring now to FIGS. 2 and 3, a cross section of the sealing station 22 of the aseptic form, fill, seal packaging machine 10 is illustrated. It should be noted that although the means for segregating is being illustrated at the sealing station 22, the means for segregating the environments can be utilized at other stations in the machine, such as, e.g., the fin sealing station, the fitment attachment station, and other stations where it is necessary or desirable to maintain a nonsterile environment in the packaging machine.

As illustrated, the sealing station 22 includes a pair of jaws 32 and 34. The first jaw 32 includes a sealing member 33 and the second jaw 34 includes a back-up member 35. The sealing member 33 functions to melt a portion of the web of film 12 so that side seals are created in the web of film. The back-up member 35 functions to urge the web of film 12 against the sealing member 33.

As illustrated in FIGS. 2 and 3, the first jaw 32 and second jaw 34 are located on opposite sides of the web of film 12, diametric to each other, i.e., facing each other. The jaws 32 and 34 function, in part, to advance the web of film 12 through the sealing stage of the form, fill, seal packaging machine. To this end, the jaws 32 and 34 are actuated and are simultaneously raised and lowered with respect to the web of film 12. An advancement of the web of film 12 is accomplished by intermittently closing and opening the jaws 32 and 34.

The jaws 32 and 34 are moved vertically, i.e., raised and lowered, by a mechanism that moves the entire sealing system up and down. To this end, the entire sealing system is secured to a carriage (not shown) and a mechanism (not shown) moves the carriage vertically. As stated above, this vertical movement of the jaws 32 and 34 functions to advance the web of film 12 through the sealing station 22.

As illustrated in FIG. 3, the jaws 32 and 34 include a pair of gripper members 36 and 38, respectively, that function, in principal part, to clamp the layers of the web of film 12 in intimate contact with each other so that the film can be sealed and severed. To sever the web of film 12, an actuated knife 37 is provided. The knife 37 is located in a channel 39 defined in the back-up member 35 of the second jaw 34 and functions to sever the web of film 12 between the side seals that are created in the web of film. The knife 37 is actuated by two air cylinders.

The heat sealing station 22 illustrated in FIG. 3 is an impulse heat sealing station. To this end, sealing elements 41 and 43 are provided. The sealing elements 41 and 43 can comprise a cannula or wire that is fired when the jaws 32 and 34 are clamped together sandwiching the web of film 12 therebetween. The sealing elements 41 and 43 cause the web of film 12 to be sealed to itself by melting a portion of the film. The top sealing element 41 functions to create a first side seal in the web of film 12 while the second element 43 functions to create a second side seal in the web of film.

As previously stated, diametric to the sealing member is a back-up member 35. The back-up member 35 includes a back-up surface 45 against which the web of film 12 is urged as it is sealed by the sealing elements 41 and 43. As illustrated in FIG. 2, the back-up bar 35 is cooled by cooling water that is fed through a pipe 44 into a channel in the back-up bar and out through a pipe 46.

The jaw members 32 and 34 are secured to plates 47 and 49, respectively. The plates 47 and 49 are journaled on rods 48 and 50. To this end, the plates 47 and 49 include guide sleeves 51*a, b, c,* and *d* that surround ball bushings 52. The guide sleeves 51*a, b, c,* and *d* and ball bushings 52 allow the plates 47 and 49 to move axially along the rods 48 and 50. The plates 47 and 49 cause the jaws 32 and 34 to move towards each other contacting the web of film 12. To cause the plates 47 and 49 to move axially each plate is secured to at least one hydraulic cylinder (not shown).

To provide an aseptic form, fill, seal packaging machine, segregating means are utilized to segregate the sterile environment 53 from the nonsterile environments. The sterile environment 53 comprises those areas in the form, fill, seal packaging machine 10 that are in fluid communication with the web of film 12 or the material to be packaged in the web of film. These sterile areas 53 are segregated from the nonsterile environments. Accordingly, the means for segregating of the present invention provides a means for isolating the nonsterile environments from the sterile environments 53.

The means for segregating comprises a plurality of boots. As used herein, the term "boots" refers to flexible members constructed from rubber or like material. Because, typically, to sterilize the internal areas of a machine, such as a packaging machine, a hydrogen peroxide fog is utilized, preferably, the boots are made of a material resistant to hydrogen peroxide. Most preferably, the boots are constructed from silicone rubber. Not only is the use of silicon rubber desirable because it is resistant to hydrogen peroxide but also because silicon rubber is resistant to heat. This is especially important at the sealing stations, wherein heat is utilized to melt a portion of the web of film 12 to create the side and fin seals as well as attach fitments.

Preferably, the boots are not only flexible but also pleated. This allows the boots to flex in response to the moving parts of the machinery. One must ensure that a pump action or other means whereby a higher pressure is obtained on the nonsterile side of the boot is not created. Such a high pressure condition in the nonsterile area, even if of a short duration, can potentially force nonsterile air or micro-organisms into the sterile areas. The boots, rods, and all attaching members must be sufficiently open and vented to prevent any potential high pressure zones in the nonsterile area or any negative pressure area in the sterile area which could contaminate the machine.

Not only do the boots ensure that the integrity of the sterile area 53 is maintained, but they prevent the sterilizing fluid from destroying or washing away the lubrication needed for the moving parts and from interfering with the nonsterile areas of the form, fill, seal packaging machine 10.

As illustrated, each rod members 48 and 50 is enclosed by a cylindrical boot 55 and 57, respectively. The cylindrical boots 55 and 57 comprise elongated cylindrical pleated rubber members. Each cylindrical boot 55 and 57 is secured around the guide sleeves 51*a* and 51*d*, and 51*b* and 51*c*, respectively, that are secured to the plates 47 and 49. The boots 55 and 57 are constructed so that the ends of the boots 55*a* and 55*b*, and 57*a* and 57*b*, respectively, receive a portion of the end of the guide sleeves 51*a* and 51*b*, and 51*c* and 51*d*, respectively. A clamp, such as a hose clamp, secures the boots 55 and 57 around the end of the guide sleeves 51*a*, 51*b*, 51*c*, and 51*d*. Of course, any means for securing the boots 55 and 57 around the guide sleeves 51*a, b, c,* and *d* can be utilized as long as it prevents leakage.

The boots 55 and 57 allow the plate members 47 and 49 to move axially along the rods 48 and 50 while at the same time segregating the nonsterile areas 59*a* and 59*b* within the boots 55 and 57 from the sterile environment 53 of the form, fill, seal packaging machine 10. This not only ensures the sterility of the sterile area 53, but ensures that needed lubrication for the rod members 48 and 50 and ball bushings 52 is not washed off the rods and ball bushings during the pre-sterilization process.

A second set of boots 61 and 63 are provided for sealing the internal nonsterile area 62 and 64, respectively, located proximate to the plates 47 and 49 and sidewalls 65 and 67. Again, the boot members 61 and 63 preferably have a flexible pleated rubber construction. As illustrated, the boots 61 and 63 extend around plate 47 and sidewall 67, and plate 49 and sidewall 65, respectively, enclosing the nonsterile areas 62 and 64, segregating them from the sterile area 53.

Each boot 61 and 63 has a substantially rectangular cross-sectional shape being secured on each of its sides 61*a, b, c,* and *d*, and 63*a, b, c,* and *d*, respectively, to side walls 65 and 67, respectively. Preferably, the sides 61*a, b, c,* and *d*, and 63*a, b, c,* and *d* are secured, as illustrated in FIG. 2, to the side walls 65 and 67 by a plate 66 and screw 68 arrangement. The plate 66 and screw 68 arrangement prevents fluid communication between the nonsterile areas 62 and 64 and sterile area 53. Of course, other means for securing the boots 61 and 63 to the side walls 65 and 67 so that fluid communication between the sterile area 53 and the nonsterile areas 62 and 64 is prevented, can be utilized.

As further illustrated in FIGS. 2 and 3, each boot 61 and 63 is secured on each of its sides 61*a'*, *b'*, *c'*, and *d'*, and 63*a'*, *b'*, *c'*, and *d'*, respectively, to the back of plates 47 and 49, respectively. Again, the boots 61 and 63 are secured to the plates 47 and 49 by a plate 66' and screw 68' arrangement.

As discussed above, the boots 61 and 63 are also pleated and constructed from a flexible material, such as silicone rubber, allowing the boots 61 and 63 to flex as the plates 47 and 49 move axially.

As illustrated in FIG. 2, there are a plurality of openings across the faces of each of the plates 47 and 49 that either must be sealed or are sealed. For example, the sealing station 22 also includes passage lines 71 and 72 for electrical lines. The passage lines 71 and 72 are potted or plugged. Preferably, the passage lines 71 and 72 are plugged with RTV silicon sealer to seal the ends thereof. The passage lines 71 and 72 provide access to the electrical connections.

Boots 81, 82, 83, and 84 are provided to allow the jaws 32 and 34 to be coupled to air cylinders 73, 74, and 75, 76, respectively. Accordingly, boots 81, 82, 83, and 84, cooperate with boots 61 and 63 to seal the nonsterile areas 62 and 64 from the sterile area 53. The air cylinders 73, 74 and 75, 76 function to vary the pressure at which the jaws 32 and 34 seal the web of film 12. The boots 81, 82, 83, and 84 seal the apertures 77, 78, and 79, 80 by sealingly receiving the piston member 73*a*, 74*a*, and 75*a*, 76*a* of the air cylinders in apertures 77, 78, and 79, 80, respectively.

As illustrated in FIG. 3, the piston 74*a* is sealingly received within the aperture 78 of the boot 82. Although only one boot 82 and piston 74 is illustrated it should be appreciated that the remaining boots 81, 83, and 84 and pistons 73, 75, and 76 have similar construction and cooperation. The boots 81, 82, 83, and 84 are also pleated so that they allow the pistons 73*a*, 74*a*, 75*a*, and 76*a* to move axially while the boots 81, 82, 83, and 84 is sealingly secured to it. As illustrated in FIG. 3, the boot 82 prevents fluid communication between a nonsterile area 62*a* in the air cylinder 74 and the sterile environment 53.

To prevent a pressure increase or build up within the non-sterile areas 62 and 64, enclosed by the boots 61 and 63 and 80, 81, 82, and 83, these areas are vented to the atmosphere. To this end, the side walls 65 and 67, as illustrated in FIG. 2, are vented via vent holes 85, 86, 87, and 88 among others and accordingly, the non-sterile areas 62 and 64 are thereby vented. As discussed in detail below, it may be desirable to provide a channel around and through the air cylinders 73, 74, 75, and 76 to cool this area. To provide a path for the air flow, the boots 80, 81, 82, and 83 should be located at a sufficiently forward end of the pistons 73*a*, 73*b*, 73*c*, and 73*d* to allow a flow of air as illustrated in FIG. 5 by the arrows.

The boots 61, 63, 80, 81, 82, and 83 function to segregate the nonsterile areas 62 and 64 located proximate to the plate members 47 and 49 and sidewalls 65 and 67, as well as the air cylinders 73, 74, 75, 76, from the sterile environment 53. Accordingly, the boots 61 and 63 cooperate with the boots 80, 81, 82, and 83, and boots 55 and 57 to segregate the nonsterile areas 59*a*, 59*b*, 62, and 64 of the sealing station 22 from the sterile environment 53 through which the web of film 12 is fed. As illustrated, the boots 55, 57, 61, 63, 80, 81, 82, and 83 allow the nonsterile areas 59*a*, 59*b*, 62, and 64 to be segregated from the sterile area 53 through the use of only eight boots.

Figure 4:
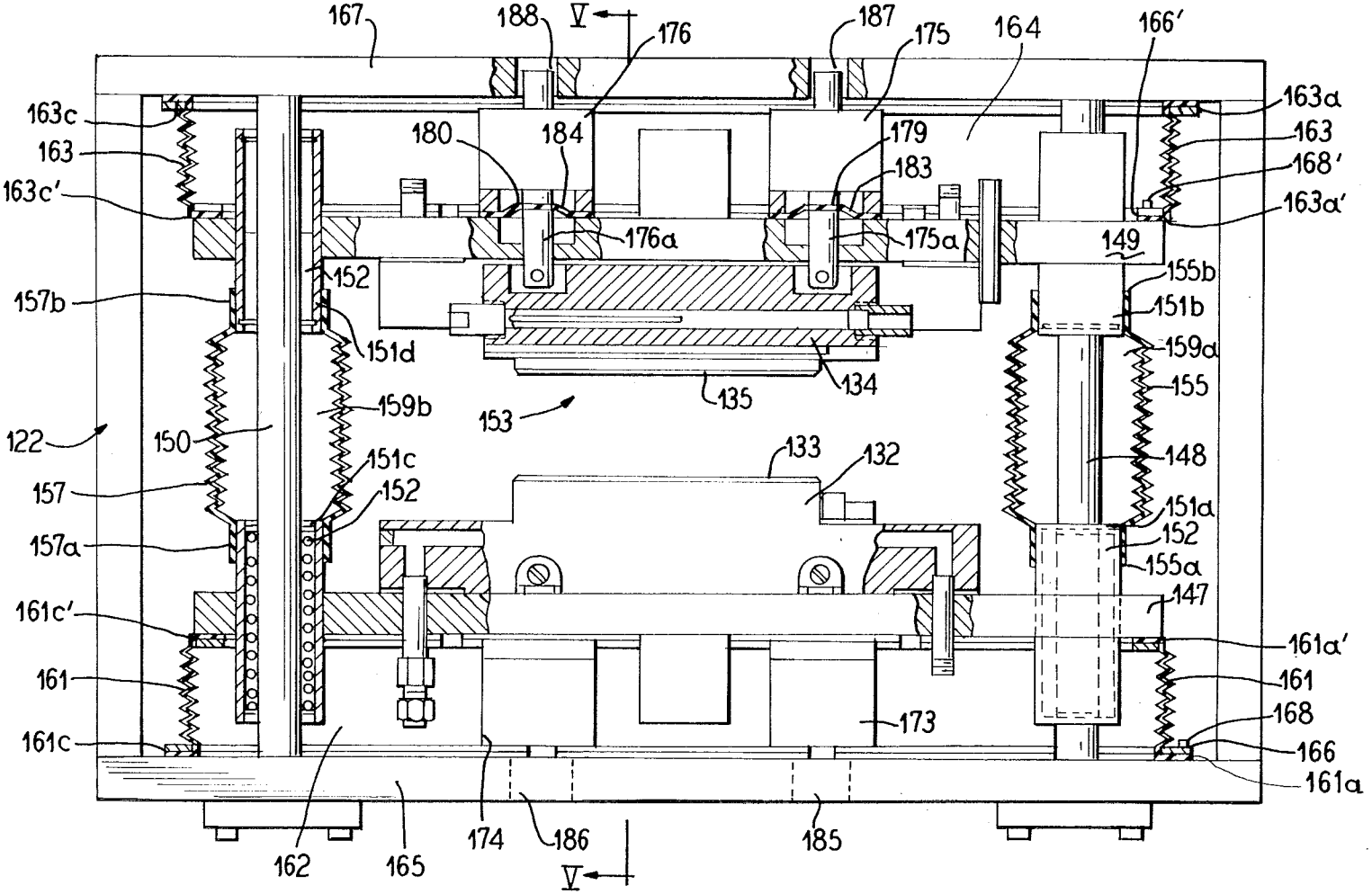
FIG. 4 illustrates a cross-sectional view of another embodiment of a heat sealing station utilizing the means for segregating of the present invention.
Figure 5:
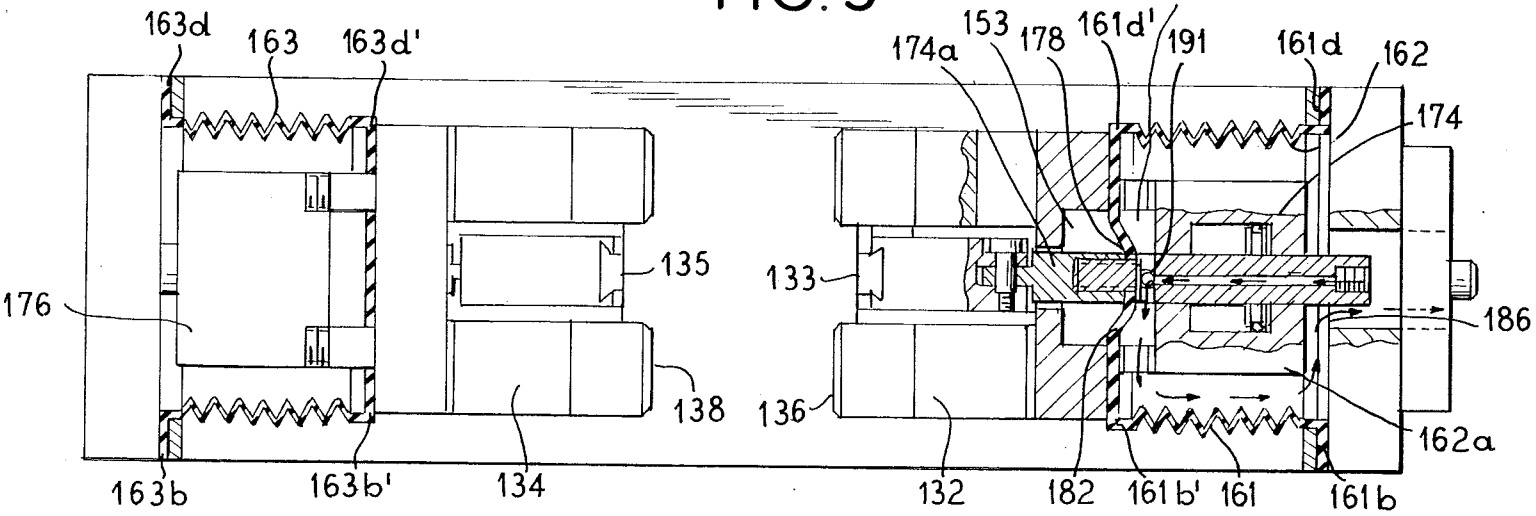
FIG. 5 illustrates a cross-sectional view of the means for segregating taken along lines IV—IV of FIG. 4.

Referring now to FIGS. 4 and 5, another embodiment of the present invention is illustrated. In this embodiment, the heat sealing station 122 utilizes a static hot bar 133 to seal the web of film 12. The sealing station 122 includes a first jaw 132 having a hot bar 133 and second jaw 134 that includes a back-up member 135 (the back-up member may also be heated similar to hot bar 133 to allow application of heat from both sides of film 12). The hot bar 133 functions to melt a portion of the web of film 12 so that the side seals in the film are created and the back-up member 135 functions to urge the film against the hot bar 133.

Again, the film 12 is advanced through the machine by intermittently closing and opening the jaws 132 and 134 while the jaws are moved vertically.

Like the previous embodiment, the first jaw 132 is secured to a plate 147 that is journaled on two rods 148 and 150 by guide sleeves 151*a* and 151*c* that have lubricated ball bushings 152. Similarly, the second jaw 134 is secured to a plate 149 that is journaled on the two rods 148 and 150 by guide sleeves 151*b* and 151*d* having lubricated ball bushings 152.

To segregate the sterile area 153 from the nonsterile areas 159*a* and 159*b* cylindrical boots 155 and 157 are utilized. Again, the cylindrical boots 155 and 157 are elongated pleated rubber members. As in the previous embodiment, each cylindrical boot 155 and 157 is secured to the guide sleeves 151*a,c* and *b,d* respectively, by a clamp or other means at an end 155*a,b*, and 157*a,b* thereof. Accordingly, the boots 155 and 157 function to enclose the nonsterile areas 159*a* and 159*b* segregating them from the sterile area 153.

Similarly to the previous embodiment, a second set of boots 161 and 163 are utilized to segregate the nonsterile environments 162 and 164 proximate the plate members 147 and 149 and sidewalls 165 and 167 from the sterile environment 153. As illustrated, the boots 161 and 163 extend around the plates 147 and sidewall 165, and plate 149 and sidewall 167, respectively, enclosing the nonsterile areas 162 and 164, segregating them from the sterile area 153.

To this end, as illustrated in FIGS. 4 and 5, the second set of boots 161 and 163 have a substantially rectangular cross-sectional shape and are secured to the side walls 165 and 167 at sides 161*a*, *b*, *c*, and *d* and 163*a*, *b*, *c*, and *d*, respectively. Although the boots 161 and 163 can be secured to the side walls 165 and 167 by any means known in the art, preferably, the boots 161 and 163 are secured to the side walls 165 and 167 by a plate 166 and screw 168 arrangement. The plate 166 and screw 168 arrangement prevents fluid communication between the sterile 153 and nonsterile 162 and 164 environments.

The boots 161 and 163 are also secured on each of its sides 161*a'*, *b'*, *c'*, *d'* and 163*a'*, *b'*, *c'*, *d'*, respectively, to the back of plates 147 and 149, respectively. Again, the boots 161 and 163 are secured to the plates 147 and 149 by a plate 166' and screw 168' arrangement.

The boots 161 and 163 are also pleated and constructed from a flexible material, such as rubber. Accordingly, the boots 161 and 163 can stretch as the plates 147 and 149 are moved axially.

Likewise, in the previous embodiment, the boots 161 and 163 cooperate with boots 180, 181, 182, and 183, to allow the jaws 132 and 134 to be coupled to air cylinders 173, 174, 175, and 176. The boots 80, 181, 182, and 183 seal the apertures 177, 178, and 179, 180 for sealingly receiving the piston member 173*a*, 174*a*, 175*a*, and 176*a* of the air cylinders 173, 174, 175, and 176. The boots 180, 181, 182, and 183 are secured around the piston portion 173*a*, 174*a*, 175*a*, and 176*a* of the air cylinders 173, 174, 175, and 176 so that there is no fluid communication between sterile area 153 and nonsterile areas 162*a, b* and 164*a, b.* Because of its flexible and pleated nature, the boots 180, 181, 182, and 184, at this portion, will stretch allowing the piston 173*a*, 174*a*, 175*a*, and 176*a* to move axially.

To prevent a pressure increase or build up within the non-sterile areas 162 and 164, enclosed by the boots 161 and 163 and 181, 182, 183, and 184 the non-sterile areas 162 and 164 are vented to the atmosphere through the side walls 165 and 167. To this end, as illustrated in FIG. 4, the non-sterile areas 162 and 164 enclosed by boots 161, 163, 180, 181, 182, and 183 are vented via vent holes 185, 186, 187, and 188 among others.

As stated above, in this embodiment of the sealing station 122, a static hot bar 133 is utilized. Due to the static hot bar 133, it is necessary to cool the air cylinders 173 and 174 to prevent the air cylinders from siezing up. It is also desirable to cool the air cylinders 175 and 176 by providing air circulation therethrough. To this end, as illustrated in FIG. 5, air flow through a channel 191 is utilized. Although only air cylinder 174 is illustrated and it should be appreciated that air cylinders 173, 175, and 176 have a similar construction and cooperation with the boot members 181, 183, and 184. Accordingly, not only is it necessary for the boot 181, 182, 183, and 184 to prevent fluid communication between the sterile area 153 and nonsterile areas 162 and 164, but it must also allow for the circulation of air around and through the air cylinders 173, 174, 175, and 176.

To provide a path for the air flow, each boot 181, 182, 183, and 184 is located at a sufficiently forward end of the pistons 173*a*, 174*a*, 175*a*, and 176*a* to allow a flow of air as illustrated by the arrows in FIG. 5. The boots 181, 182, 183, and 184 thereby allow a flow of air cooling this area and preventing the air cylinders 173, 174, 175, and 176 from siezing up, but, segregate this non-sterile environment. Accordingly, although cooling air is allowed to circulate as indicated by the arrows, it does not contaminate the sterile area 153.

As illustrated above, in both embodiments, by utilizing the means for segregating of the present invention, only eight boots are needed to segregate the sterile area from the nonsterile areas at the sealing station of a form, fill, seal packaging machine. Similarly, at other stations, a limited number of boot members are only required to segregate the sterile and nonsterile areas providing an aseptic packaging machine.

The means for segregating of the present invention provides a method and apparatus for segregating nonsterile areas from sterile areas. Moreover, the means for segregating provides a means and apparatus for segregating particulate matter from the sterile packaging areas. The apparatus of the present invention allows all the functions of a typical sealing system, e.g., heating, cooling, and independent pressure, to be utilized without contamination of the sterile environment. Although the means for segregating has been illustrated at the side seal station, it of course, can be utilized in other areas of the machine, e.g., fin seal station and fitment attachment station.

In both embodiments of the invention, the sterile area of the cabin is under a positive pressure. Accordingly, all seal leaks will vent to the non-sterile areas.

It should be understood that various changes and modifications to the preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

We claim:

1. A packaging machine comprising:

a sterile area through which a web of flexible film is fed;

a nonsterile area;

a plurality of pleated, flexible rubber members for segregating the sterile areas from the nonsterile areas;

means for venting the pleated, flexible rubber members to prevent a build-up of pressure, the means for venting being so constructed and arranged that the nonsterile area is vented without contaminating the sterile area; and sealing means for heat sealing a web or film, the sealing means including a sealing member and means for urging the sealing bar against the web of film, the packaging machine including means for circulating air through portions of the sealing means to cool same, at least one of the rubber members cooperating with the means for circulating to allow air to circulate and cool the portion of the sealing means while preventing contamination of the sterile areas.

2. The packaging machine of claim 1 including a static sealing system for creating side seals in the web of film.

3. The packaging machine of claim 1 including an impulse sealing system for creating side seals in the web of film.

4. The packaging machine of claim 2 wherein:

at least four pleated flexible rubber members the nonsterile internal portions of the sealing system from the sterile area.

5. The packaging machine of claim 3 wherein at least four pleated flexible rubber members segregate the nonsterile internal portions of the sealing system from the sterile area.

6. A packaging machine for creating from a web of flexible film a bag for housing a product comprising:

means for feeding a web of film through the packaging machine;

a sealing station for heating the web of film to create seals in the web of film, the sealing station including a pair of jaws located diametric each other, one of the jaws having coupled thereto means for heating the web of film, and the second jaw having coupled thereto a back-bar, the jaws being coupled to means for urging the jaws towards each other;

means for segregating a sterile area of the packaging machine, through which the web of film is fed, from nonsterile areas, the means including a plurality of flexible, pleated boots, the boots segregating nonsterile internal areas of the sealing station from the sterile area by enclosing portions of the nonsterile areas;

means for venting the portions of the nonsterile area enclosed by the boots to prevent a build-up of pressure in the nonsterile areas, the means for venting being so constructed and arranged that the nonsterile areas are vented without contaminating the sterile area; and wherein the sealing station includes means for circulating a fluid to cool at least portions of the sealing station at least one of the boots that segregates the sealing station cooperates with the means for circulating a fluid to allow the fluid to circulate within the nonsterile areas without contaminating sterile areas.

7. The apparatus of claim 6 including:

at least one rod for allowing the jaws to move axially toward each other, each jaw is coupled to a plate and the plates are journaled on the rod by means for journalling the jaws; and a flexible, pleated boot for segregating a nonsterile area of the rod and means for journalling the jaws from the sterile area.

8. The apparatus of claim 7 wherein:

two rods are provided;

the means for journalling the plates to the rods includes a collar coupled to each plate; and two pleated boots are provided each pleated boots being clamped at an end thereof around a collar.

9. The apparatus of claim 6 wherein:

each jaw is coupled to a plate; and a pleated flexible boot extends from a side wall to each of the plates segregating the nonsterile areas located proximate the plate from the sterile area.

10. The apparatus of claim 9 wherein the boots extending from the side wall to the plates have a substantially rectangular cross-sectional shape.

11. The apparatus of claim 6 wherein the means for heating the web of film is a static hot bar system.

12. The apparatus of claim 6 wherein the means for heating the web of film is an impulse system.

13. The apparatus of claim 9 wherein:

the jaws are coupled to air cylinders that independently vary the pressure at which the jaws seal the web of film; and the means for segregating the sterile area includes a second plurality of flexible boots including apertures for sealingly receiving the piston portions of the air cylinders segregating the nonsterile areas of the air cylinders from the sterile area.

14. The apparatus of claim 6 wherein the boots are constructed from silicone.

15. The apparatus of claim 10 wherein the boots are secured to the side walls and plates by a plurality of plates each plate receiving at least one screw that is correspondingly received by the side wall or plates.

16. A form, fill, seal packaging machine for creating from a web of film a bag for housing a product comprising:

means for feeding a web of film through the form, fill, seal packaging machine;

a sealing station for heating the web of film to create seals in the web of film, the sealing station including a pair of jaws located diametric each other, at least one of the jaws including means for heating the web of film, each jaw being secured to a plate member that is journaled on a pair of rods, the plate members being moveable axially towards each other;

means for segregating a sterile area of the packaging machine, through which the web of film is fed, from nonsterile areas of the sealing station, the means including a plurality of flexible pleated boots for segregating an internal area of the rods and internal areas proximate the plate members from the sterile areas;

means for venting the nonsterile areas segregated by the boots to prevent a build up of the pressure in the segregated nonsterile areas, the means for venting being so constructed and arranged that the nonsterile areas are vented without contaminating the sterile areas; and wherein the sealing station includes means for circulating a fluid to cool at least portions of the sealing station at least one of the boots that segragates the sealing station cooperates with the means for circulating a fluid to allow the fluid to circulate within the nonsterile areas without contaminating sterile areas.

17. The apparatus of claim 16 wherein the means for segregating includes at least two pairs of flexible pleated boots, a first pair of flexible boots extending from each of the plate members around each rod member segregating the internal area of the rod members from the sterile area and each of a second pair of boots extending from a separate side wall to a separate plate member segregating the internal areas proximate the plate member from the sterile area.

18. The apparatus of claim 17 wherein the jaws are coupled to air cylinders that are coupled to the plate members and the means for segregating includes at least two additional boots including apertures for sealingly receiving the piston portion of the air cylinders to segregate an internal area of the air cylinder from the sterile area.

19. The apparatus of claim 18 wherein the means for heating is a static hot bar and the boot enclosing the plate to which the jaw having means for heating is coupled is so constructed and arranged that cooling air can flow around and through the air cylinders secured to the jaw.

20. The apparatus of claim 17 wherein the means for heating is an impulse system.

21. The packaging machine of claim 1 wherein the means for circulating includes a channel defined, in part, by portions of the rubber members and the sealing means.

22. The packaging machine of claim 6 wherein the means circulating a fluid includes a channel defined, in part, by portions of the boots and the sealing station.

23. The form, fill, seal packaging machine of claim 16 wherein the means for circulating a fluid includes a channel defined, in part, by portions of the boots and the sealing station.

* * * * *

UNITED STATES PATENT AND TRADEMARK OFFICE

CERTIFICATE OF CORRECTION

PATENT NO. : 4,803,827

DATED : February 14, 1989

INVENTOR(S) : John L. Posey, Ronald W. Swank, and Frederic L. Grude

It is certified that error appears in the above–identified patent and that said Letters Patent is hereby corrected as shown below:

In column 10, at line 43, after "members" insert --segregate--.

Signed and Sealed this

Second Day of January, 1990

*Attest:*

JEFFREY M. SAMUELS

*Attesting Officer*

*Acting Commissioner of Patents and Trademarks*